United States Patent [19]

Gutierrez et al.

[11] 4,263,732

[45] Apr. 28, 1981

[54] SELF-LOCKING PHOTOGRAPHIC PRINT DISPLAY FRAME

[76] Inventors: Julian Gutierrez, 6205 SW. 116 St., Miami, Fla. 33156; Guillermo Gonzales, 9151 Fountainbleau Blvd., Unit 5, Miami, Fla. 33172

[21] Appl. No.: 90,893

[22] Filed: Nov. 5, 1979

[51] Int. Cl.[3] ..... G09F 1/12

[52] U.S. Cl. ..... 40/152.1

[58] Field of Search ..... 40/10, 152.1, 152, 156; 248/473

[56] References Cited

U.S. PATENT DOCUMENTS

| | | | |
|---|---|---|---|
| 2,112,583 | 3/1938 | Tucker et al. | 40/152.1 |
| 2,524,647 | 10/1950 | Baidwin | 248/473 |
| 4,165,572 | 8/1979 | Sussman | 40/152.1 |

FOREIGN PATENT DOCUMENTS

| | | | |
|---|---|---|---|
| 282311 | 7/1952 | Switzerland | 40/152.1 |

*Primary Examiner*—Gene Mancene
*Assistant Examiner*—Wenceslao J. Contreras
*Attorney, Agent, or Firm*—Leo Gregory

[57] ABSTRACT

A readily assembled self-locking photographic print display frame which consists of a substantially U-shaped base member in which the web has a pair of spaced aligned vertical slots and respectively spaced therebehind are a pair of vertical T-slots, upstanding from and removably secured in the pair of T-slots is a backing frame member and upstanding from the first pair of slots is a transparent face plate member having a pair of depending angled leg members such that when disposed into the first pair of slots causes the face plate member to be angled relative to the backing plate member and have a pressure engagement therewith to secure therebetween a photographic print.

11 Claims, 20 Drawing Figures

FIG. 7
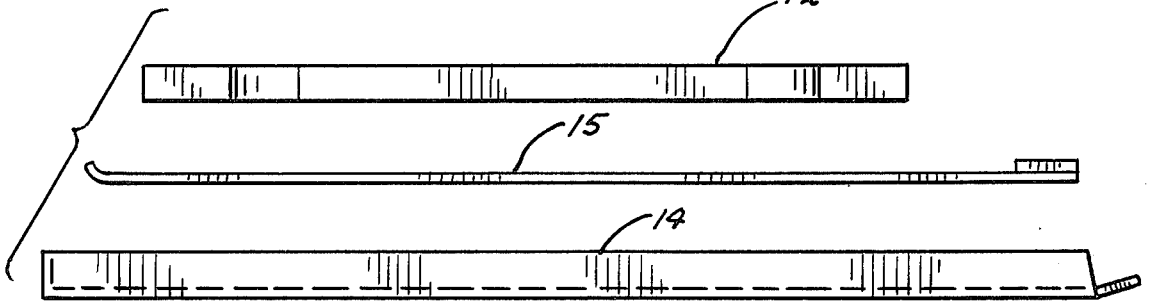
FIG. 8
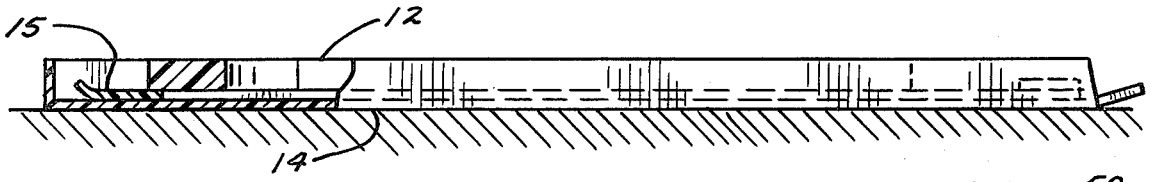
FIG. 9
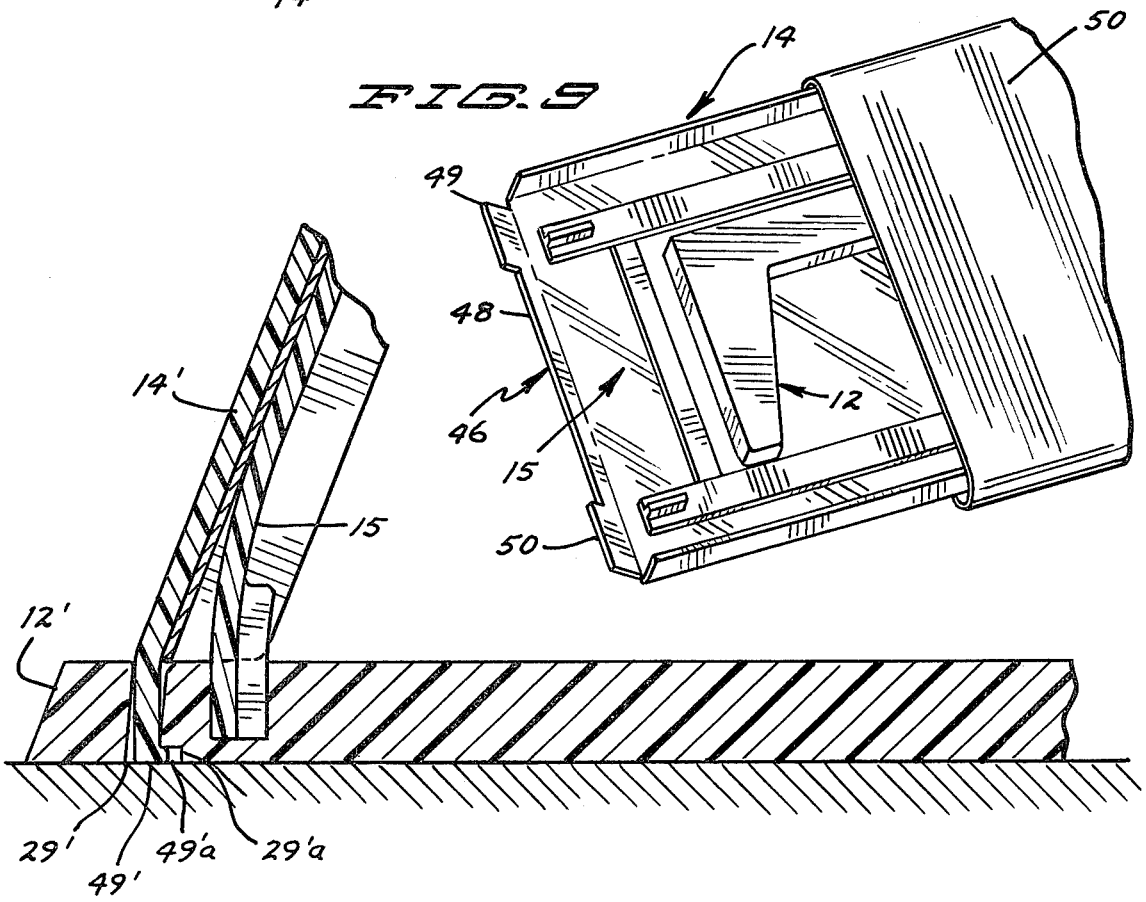
FIG. 10

SELF-LOCKING PHOTOGRAPHIC PRINT DISPLAY FRAME

BACKGROUND OF THE INVENTION

1. Field of Invention

This invention relates to a self-locking readily assembled photographic print display frame.

2. Description of the Prior Art

Self-standing frames to display photographic prints have in general easel back supporting members having a backing plate member which slides out of a channel frame, others have a projecting leg clipped onto the body portion of the frame and some have a grooved base plate holding a pair of substantially overlying plate members to receive a print therebetween.

In the alternative to having a removable base supporting member, prior art structures are known to have a unitary construction with a rearwardly angled base and having a cover plate carried by a backing plate and separable therefrom sufficiently for the insertion of a photographic print therebetween.

SUMMARY OF THE INVENTION

The invention herein relates to a light weight readily assembled self-locking frame member adapted to hold for display a photographic print. It is desirable to have and it is an object to this invention to provide a frame member to display a photographic print, said frame member consisting of a supporting base member, a backing plate removably upstanding from said base member, and a transparent face plate member removably upstanding from said base plate member and being angled vertically relative to said backing plate member to bear thereagainst and secure a photographic print therebetween.

It is more specifically an object of this invention to provide a frame member to hold and display a photographic print, said frame member being of light weight having its parts molded of a suitable plastic material such as polystyrene, said frame member consisting of a substantially flat U-shaped base member having a pair of leg portions extending rearwardly from a connecting web portion, a backing frame member removably upstanding from said web portion, a transparent face plate member removably upstanding from said web portion, said face plate member being angled relative to said backing plate member to bear thereagainst for a pressure engagement therewith, to lock the same into the base member and to removably secure a photographic print therebetween.

It is a further object of this invention to provide a structure as set forth in the preceding object whereby the base member, the backing plate member and the face plate member are disassembled and disposed into a nested flat condition for insertion into an envelope, as for packaging and mailing.

These and other objects and advantages of the invention will be set forth in the following description made in connection with the accompanying drawings in which like reference characters refer to similar parts throughout the several views.

DESCRIPTION OF THE DRAWINGS

FIG. 7 is a composite view showing the component parts in separated condition;

FIG. 8 is a view in side elevation showing the component parts in nested condition with a portion thereof broken away and in vertical section;

FIG. 9 is a view in perspective showing the component parts in nested condition partially inserted into an envelope;

FIG. 10 is a broken view in vertical section showing a modification of a detail;

DESCRIPTION OF A PREFERRED EMBODIMENT

Figure 3:
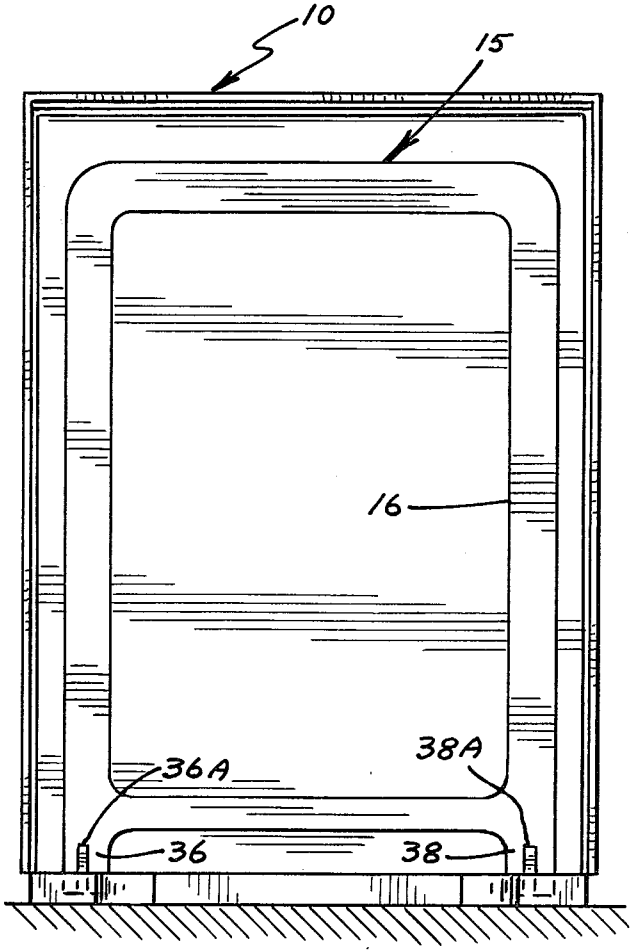
FIG. 3 is a view in rear elevation.
Figure 2:
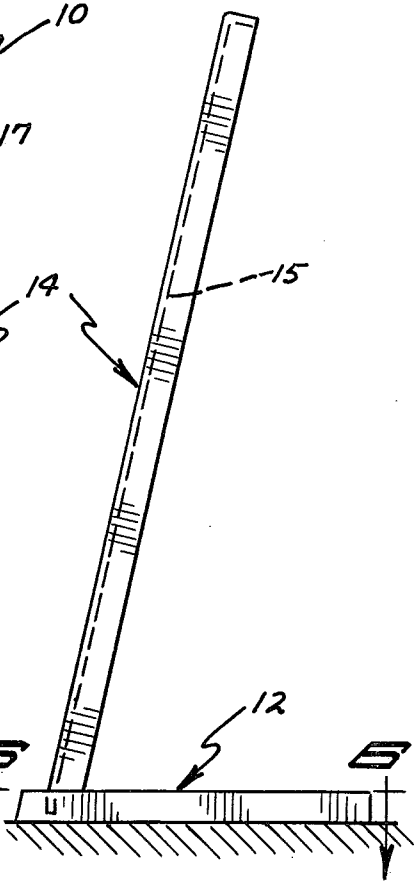
FIG. 2 is a view in side elevation.
Figure 1:
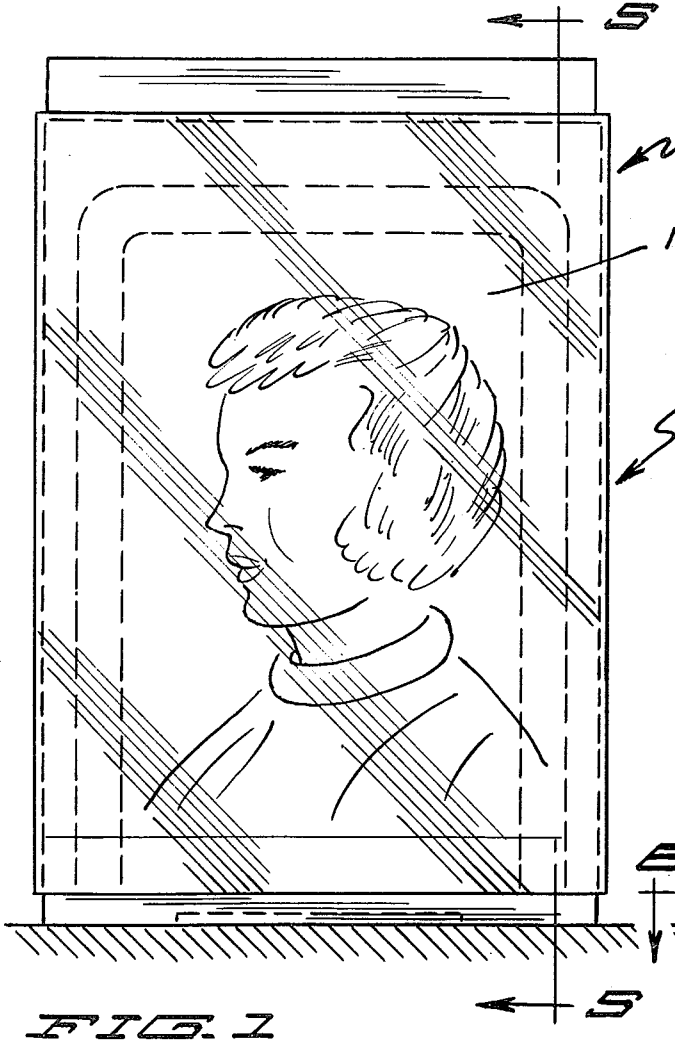
FIG. 1 is a view in front elevation with a portion thereof broken away and other portions shown in dotted line.

Referring to the drawings and particularly to FIGS. 1-3, the product therein comprising a self-locking photographic print display frame is indicated generally by the reference numeral 10 and comprises a base member 12, a facing or cover plate member 14, a rear or backing frame member 15 and as shown in FIG. 1, a photographic print 17 is shown positioned for display.

The product herein is formed as a molded product of a suitable plastic material having substantial rigidity with some degree of resilience such as polystyrene.

Figure 6:
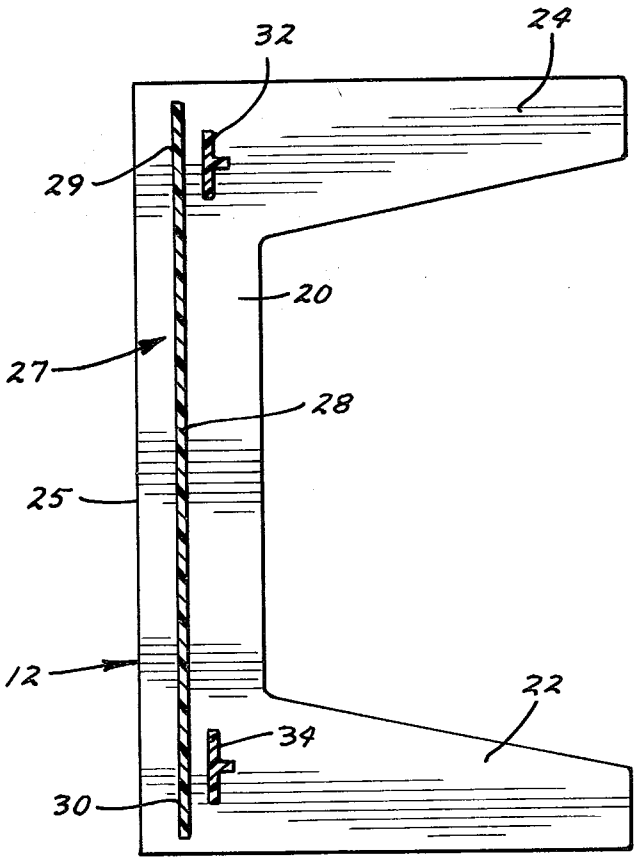
FIG. 6 is a view in horizontal section taken on line 6—6 of FIG. 2 as indicated.

As illustrated in FIG. 6, the base 12 is substantially U-shaped in plan having a web or connecting portion 20 and leg portions 22 and 24 extending rearwardly from each end portion of said web 20.

Extending longitudinally of said web 20 spaced somewhat rearwardly of its leading edge 25 is an open top vertical slot 27 having a central relatively shallow portion 28 and deeper slot portions 29 and 30 at either end thereof. The leading edge of said edge portion 25 is shown to be beveled as at 26.

Spaced somewhat rearwardly of said slot portions 29 and 30 are T-slots 32 and 34 extending substantially into but preferably not fully through said web 20.

Adapted to be supported in said slots 32 and 34 in an upstanding position is a backing frame or back rest member 15 substantially rectangular in plan and frame-like in form, having an open central portion 16 and having a pair of depending leg portions 36 and 38 having rearwardly extending ribs 36A and 38A respectively, said leg portions being arranged and constructed to fit securely within said T-slots 32 and 34.

Adapted to be supported in an upstanding position in said slot 27 is the facing or cover plate member 14 comprising a transparent front wall 40 having a rearwardly extending right angle flange edge portion 42 extending along the sides and top thereof and these form a shallow chamber 44 therein. Extending across the lower end portion of said plate member 14 and depending therefrom in a rearwardly angled position is a flange-like leg portion 46 having a relatively narrow central portion 48 to be received within the shallow slot portion 28 and having at either end thereof leg portions 49 and 50 of greater length to be received within the slot portions 29 and 30. It will be noted that said leg portion as shown does not extend to underlie the lower ends of the side walls of the flange 42.

The slot 27 is beveled at its upper rear wall as at 27*a* for easy insertion of the member 14.

Figure 5:
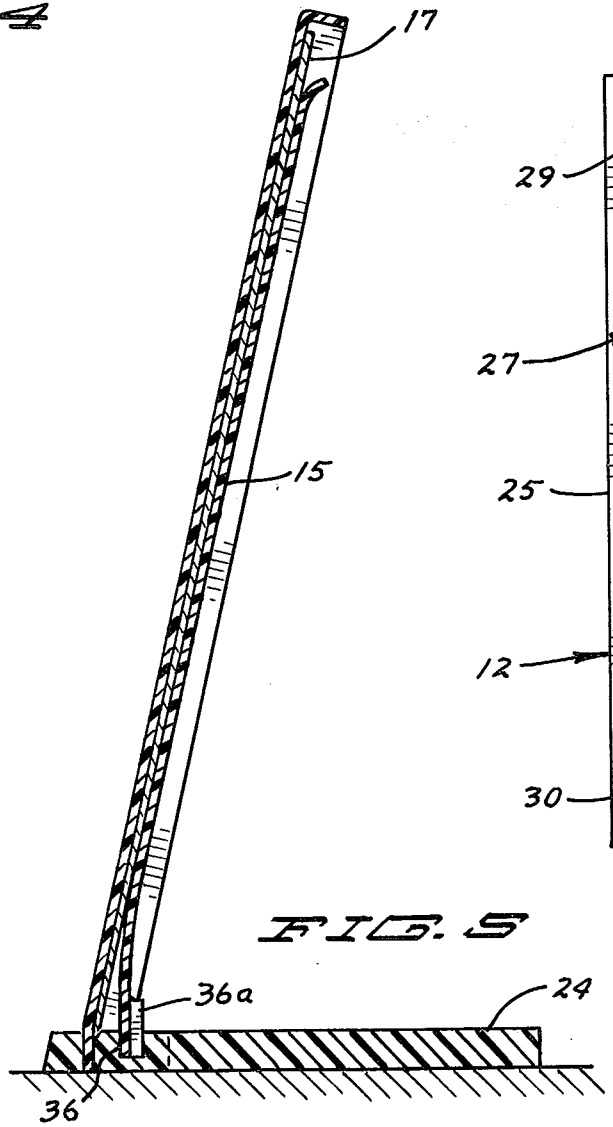
FIG. 5 is a view in vertical section taken on line 5—5 of FIG. 1 as indicated.
Figure 4:
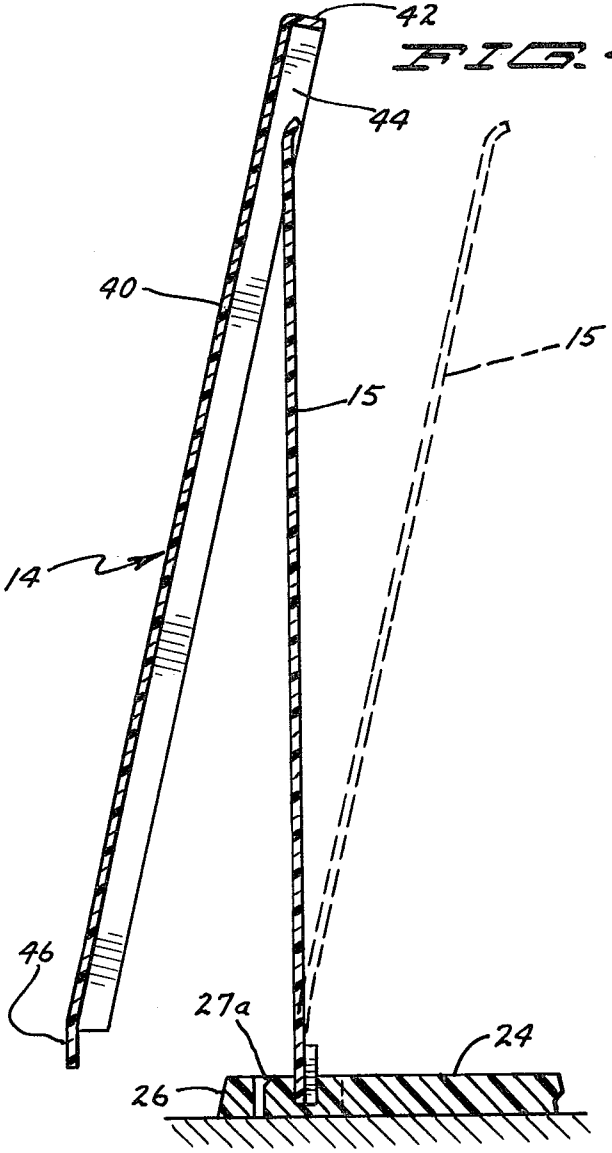
FIG. 4 is a broken view in vertical section taken on line 4—4 of FIG. 1, as indicated with a portion thereof in separated position and another portion thereof in dotted line in an alternate position.

With the member 15 positioned upon the base member 12 to be upstanding therefrom substantially at right angles to a horizontal plane, as shown in FIG. 4, and with the member 14 having its angled depending leg portion 46 disposed within said slot 27, it will be seen that said member 14 will be positioned to be rearwardly angled to engage and bear against the upstanding member 15 and cause said member 15 to yield rearwardly as indicated in FIG. 4, in dotted line and as shown in FIG. 5, whereby there will be pressure engagement between said two members, and thus they become locked in position.

With reference to FIGS. 7–9, it is seen that the members 14 and 15 are readily removed from or pulled out of said base member 12 and the rear frame member 15 with the base member 12 nested therein in turn nests within the facing plate member 14 to be in substantially flat condition as viewed in FIG. 8, and the same is shown partially inserted into an envelope or a like flat container 50.

OPERATION

With reference to the above description, a very convenient to use photographic print holder is provided. The assembly is very simple. The backing frame member 15 is positioned upright in the base member 12 by the insertion of its leg members into the T-slots 32 and 34 and the facing or cover plate member 14 is disposed to have its leg portion 46 positioned into the slot 27 whereby in its assembled position as shown in FIG. 5, said facing plate member bears against the backing frame member 15 and particularly the upper portion thereof, causing the backing frame member to yield rearwardly as illustrated whereby a photographic print is held very securely between said facing plate member and said backing frame member. The photographic print 17 may be inserted by a slight separation of the members 14 and 15 as said members are positioned upon the base member 12 or the photographic print may be placed in position overlying the member 15 prior to the insertion of the face plate member 14 into its assembled or operating position.

With reference to FIGS. 7–9, there is shown how compactly the three component parts, namely, the facing plate member, the backing frame member and the base member, can be nested for insertion into an envelope or an equivalent container as for packing or mailing purposes.

It will be understood that the pressure engagement between the facing plate member 14 and the backing frame member 15 may be brought about by various relative angular relationships of the leg portions of said members and of their respective slots in the base member 12.

MODIFICATION

In the modifications to be hereinafter described, all like parts above described bear the same reference numerals and such parts as are modified bear like reference numerals with a prime added and some will bear new reference numerals. 49 and 50 of the face plate member 14 are modified as represented by the leg member 49′ in having a ledge like rearward extended projection 49′*a*. The slot 29 shown as 29′ is widened to accommodate said projection and is further modified by having a rearwardly extending undercut groove at each end portion thereof as represented by the undercut groove 29′*a* having said projection nested therein. Thus, the face plate member indicated by 14′ as modified becomes more securely positioned than previously in upstanding from the base member 12′.

Figure 11:
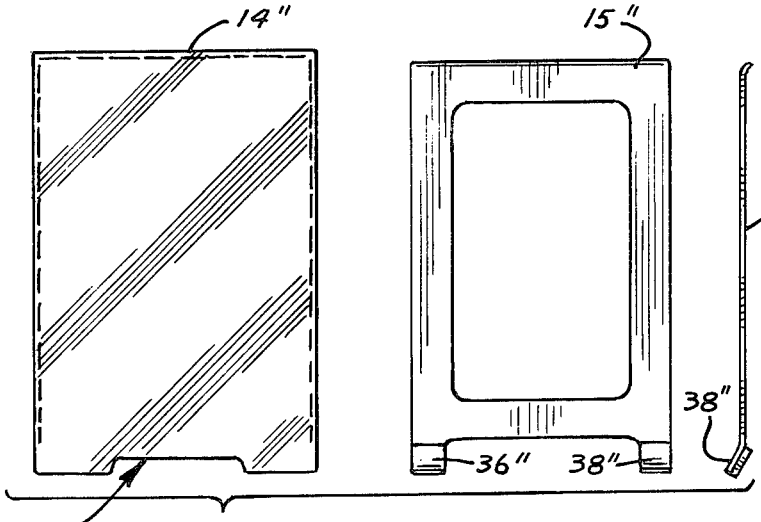
FIG. 11 is a composite view of a modification showing portions thereof in front and in side elevation.
Figure 12:
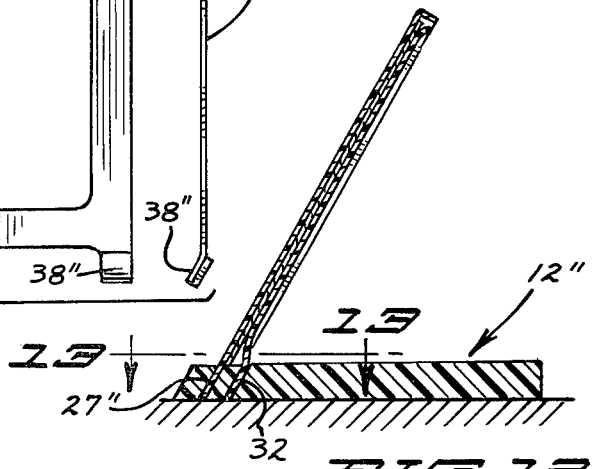
FIG. 12 is a view in vertical longitudinal section.
Figure 13:
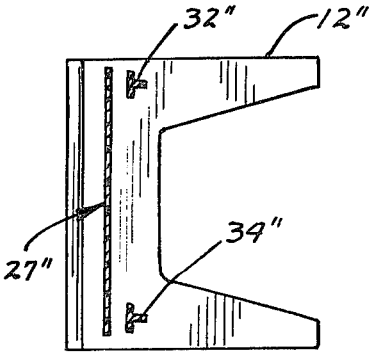
FIG. 13 is a broken view in horizontal transverse section taken on line 13—13 of FIG. 12 as indicated.

An illustration of another modification is shown in FIGS. 11–13 wherein the face plate member 14″ has a coplanar depending leg member 46″ to be disposed into the slot 27″ of the base member 12″ which slot is angled or inclined rearwardly and the backing frame member 15′ has its leg portions 36″ and 38″ angled forwardly in the direction of the face plate member as shown and said leg portions are disposed into the T-slots 32″ and 34″ which are inclined to be in planes parallel to the plane of the slot 27″. Other than being angled forwardly, said leg member 36″ and 38″ are formed to be the same as the leg member 36 and 38.

In assembled condition, the above modified structure is shown in FIG. 12 and operates to holding a photographic print as first above described.

Figure 14:
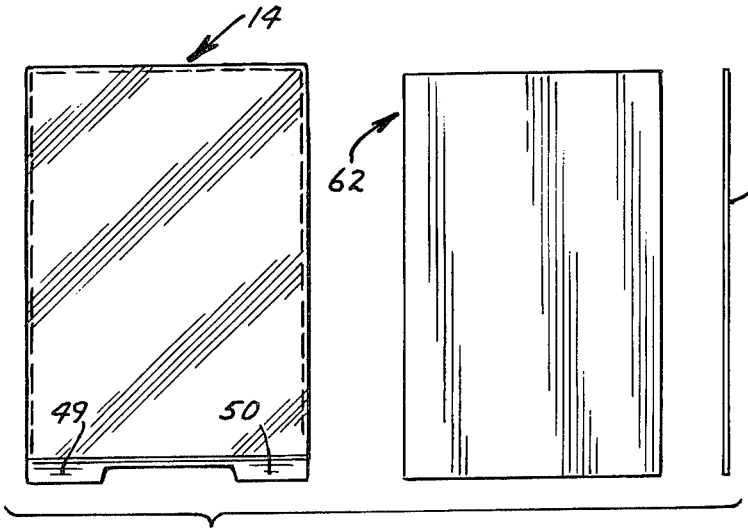
FIG. 14 is a composite view of a modification otherwise similar to FIG. 11.
Figure 15:
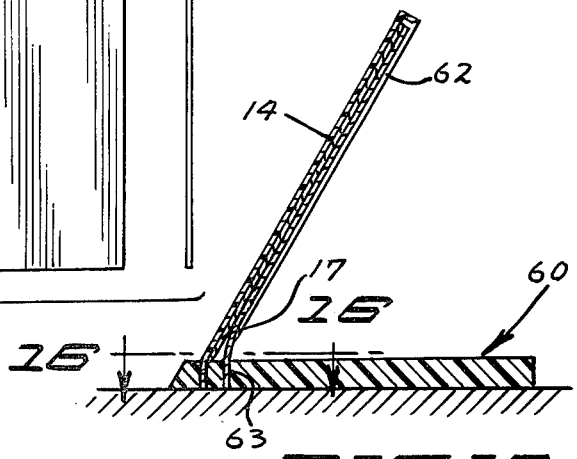
FIG. 15 is a view of the modification of FIG. 14 in vertical longitudinal section.
Figure 16:
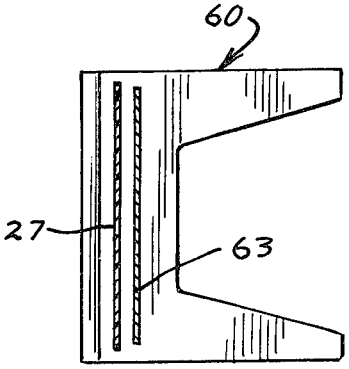
FIG. 16 is a broken view in horizontal transverse section taken on line 16—16 of FIG. 15 as indicated.
Figure 17:
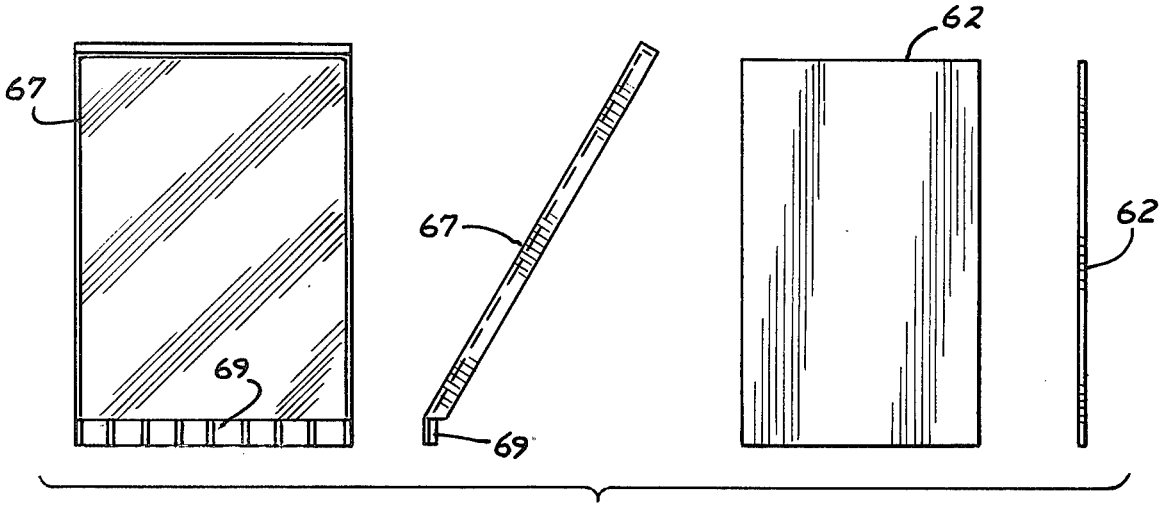
FIG. 17 is a composite view of another modification shown in front and side elevation.

Referring to FIGS. 14–16, another modification is shown which embodies the face plate member 14, the base member 12 and the groove 27. A change in structure is indicated in the backing frame member 60 which is very conveniently formed of corrugated paper or cardboard which has sufficient flexibility that when positioned upright in the vertical slot 63 will yield rearwardly under the pressure of the face plate member 14 as shown in FIG. 15.

The operation of the modified structure is as in the operation first above described.

Referring now to FIGS. 17–20 another modification is shown in which a base member 65 is identical to the base member 12 with the exception of having a single vertical groove 66 therein extending substantially across the width of said base member.

Disposed into said groove to be upstanding therefrom is backing frame member 62 and adapted to be disposed into the same groove is the face plate member 67 identical to the member 14 with the exception of having a rearwardly angled leg portion having projecting rearwardly thereof spaced ribs 69 thereacross.

Said ribs 69 will be of such length that when disposed into said groove 66, they will have a tight fit with said backing frame member, such that both of said members will be securely held within said groove.

Figure 18:
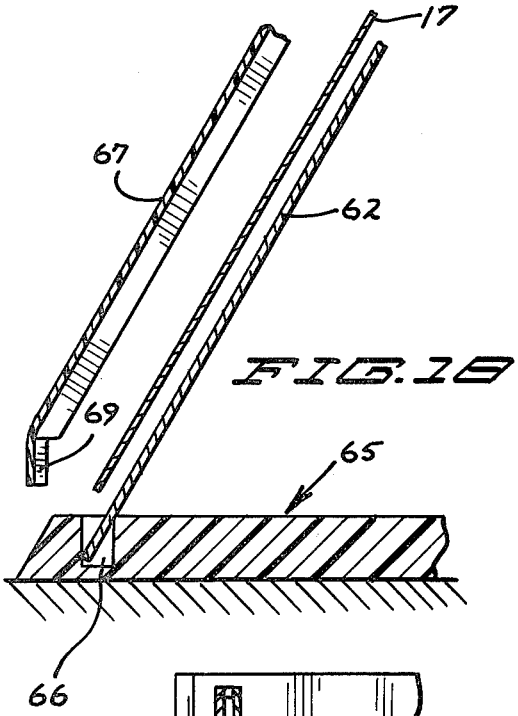
FIG. 18 is a partially broken view in vertical longitudinal section of the modification of FIG. 17 showing various portions in separated position.
Figure 19:
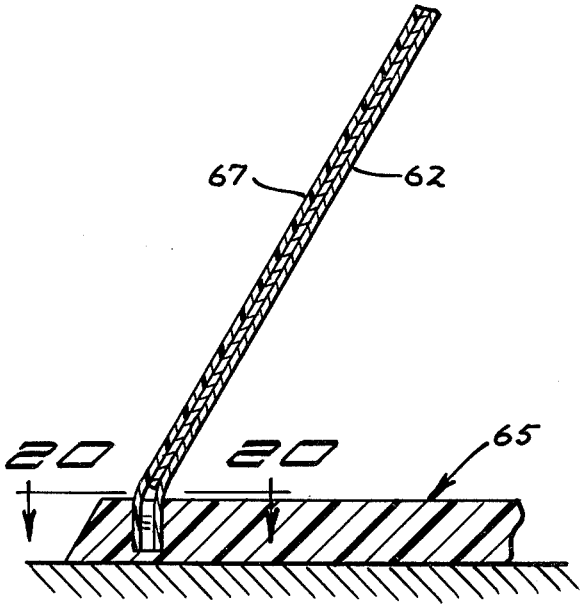
FIG. 19 is a view similar to that of FIG. 17 showing the portions thereof in operating position.
Figure 20:
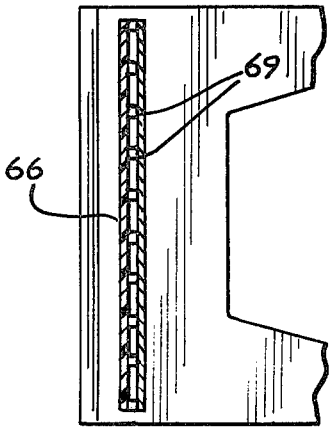
FIG. 20 is a broken view in horizontal transverse section taken on line 20—20 of FIG. 19 as indicated.

The upper portion of said face plate member 67 is angled as shown in FIGS. 18 and 19 to bear against the backing frame member 62 to cause the same to yield rearwardly.

The photo print 17 is readily inserted by slight separation of the facing plate member and the backing frame member.

It will of course be understood that various changes may be made in the steps and sequence of steps of the method and apparatus to connection therewith without departing from the scope of applicant's invention which, generally stated, consists in a method capable of carrying out the objects above set forth, such as disclosed and defined in the appended claims.

What is claimed is:

1. A self-locking photographic print holding display frame, having in combination a substantially flat base plate member comprising a web having a pair of rearwardly extending leg portions, said web having a slot extending substantially thereacross, a pair of spaced slots in said web member respectively disposed rearwardly of said first mentioned slot, a backing plate member removably upstanding from said base plate member having a depending portion disposed into said pair of slots, a face plate member, a leg portion depending from said face plate member removably disposed into said slot, and said leg portion of said face plate member being angled to position said face plate member to be inclined toward said backing plate member to bear thereagainst and have a pressure engagement therewith locking the same into said base plate member.

2. The structure set forth in claim 1, wherein said backing plate member is a substantially rectangular frame, and said depending portion thereof comprises a pair of depending leg portions.

3. The structure set forth in claim 2, wherein said pair of slots are substantially T-shaped in horizontal section, and said depending leg portions of said backing frame member have a configuration in horizontal section conforming to that of said pair of slots.

4. The structure set forth in claim 1, wherein said face plate member has an angled peripheral edge portion along the sides and top thereof.

5. The structure set forth in claim 1, wherein said first mentioned slot has a rearward extending undercut groove portion therein, and said leg member depending from said facing plate member has a projection disposable within said undercut groove portion.

6. The structure set forth in claim 1 including a photographic print disposed between said face plate member and said backing plate member.

7. The structure set forth in claim 1, wherein said backing plate member, said facing plate member and said base member are adapted to be disassembled and nested in a substantially flat condition.

8. The structure set forth in claim 1, wherein said face plate member is substantially flat in plan, said backing plate member is disposed to overlie said face plate member, and said base member is adapted to be disposed to overlie said facing plate member nested within said backing plate member.

9. A self locking photographic print holding display frame, having in combination a substantially flat base plate member comprising a web having a pair of rearwardly extending leg portions, said web having a slotted portion transversely thereof, a facing plate member adapted to display a photographic print therethrough, a backing plate member, said last two mentioned plate members having depending portions adapted to be disposed to be upstanding from said slotted portion of said base plate member, and the lower portion of one of said second and third mentioned plate members being inclined relative to the other cause a pressure engagement therebetween whereby said second and third mentioned plate members are self locked into said base plate member.

10. The structure of claim 9 wherein the lower end portion of one of said second and third mentioned plate members has a plurality of ribs thereacross disposable within said groove to engage the adjacent portion of the other of said second and third mentioned plate members.

11. The structure set forth in claim 9 wherein said slotted portion comprises a single groove and a pair of spaced grooves aligned with and spaced from said first single groove, and said second and third mentioned plate members respectively are adapted to have their lower end portions disposed into said single groove and said pair of spaced grooves.

* * * * *